US010598469B2

(12) United States Patent
Lankford

(10) Patent No.: US 10,598,469 B2
(45) Date of Patent: Mar. 24, 2020

(54) FORWARD DEPLOYING, REAR ACTIVATED, DELAYED OPENING, BROADHEAD

(71) Applicant: Mickey Don Lankford, Pawleys Island, SC (US)

(72) Inventor: Mickey Don Lankford, Pawleys Island, SC (US)

( * ) Notice: Subject to any disclaimer, the term of this patent is extended or adjusted under 35 U.S.C. 154(b) by 0 days.

(21) Appl. No.: 15/915,143

(22) Filed: Mar. 8, 2018

(65) Prior Publication Data

US 2018/0283835 A1 Oct. 4, 2018

Related U.S. Application Data

(60) Provisional application No. 62/477,508, filed on Mar. 28, 2017.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 4,099,720 A 7/1978 Zeren
4,932,671 A 6/1990 Anderson
5,078,407 A 1/1992 Carlston et al.
5,082,292 A 1/1992 Puckett et al.
5,112,063 A 5/1992 Puckett
5,820,498 A * 10/1998 Maleski ..... F42B 6/08 473/584
5,879,252 A * 3/1999 Johnson ..... F42B 6/08 473/583
6,015,357 A 1/2000 Rizza
6,200,237 B1 3/2001 Barrie
6,217,467 B1 * 4/2001 Maleski ..... F42B 6/08 473/583
6,270,435 B1 * 8/2001 Sodaro ..... F42B 6/08 473/583
6,283,880 B1 9/2001 Barrie
6,287,224 B1 * 9/2001 Liechty, II ..... F42B 6/08 473/583

(Continued)

*Primary Examiner* — Alvin A Hunter
*Assistant Examiner* — Christopher Glenn
(74) *Attorney, Agent, or Firm* — R. K. Merting, LLC; Robert K. Merting

(57) ABSTRACT

The present invention comprises a novel broadhead generally consisting of a means to attach said broad-head to an arrow shaft, a ferrule with longitudinal slots for recessed blades and a perpendicular circular indentation to hold an o-ring, a tip to provide aerodynamic flight and a cutting surface, pivoting forward deploying blades, and a delayed deployment mechanism designed to trigger deployment of the blades after the broadhead has entered the target. An o-ring may be positioned on the ferrule to hold the blades in the recessed position until deployment is triggered by the delayed deployment mechanism. In preferred embodiments, the design of the pivot point and the slots in the ferrule only allow the blades to deploy to a position slightly greater than perpendicular to the ferrule. Also in preferred embodiments, the blades are fully recessed and will remain so until the broadhead has entered the target.

16 Claims, 11 Drawing Sheets

(56) References Cited

U.S. PATENT DOCUMENTS

| | | | | |
|---|---|---|---|---|
| 6,517,454 | B2 | 2/2003 | Barrie et al. | |
| 6,554,727 | B1 * | 4/2003 | Armstrong | F42B 6/08 473/583 |
| 6,595,881 | B1 | 7/2003 | Grace, Jr. et al. | |
| 6,669,586 | B2 | 12/2003 | Barrie et al. | |
| 6,749,801 | B1 * | 6/2004 | Grace, Jr. | B22F 3/22 419/36 |
| 6,910,979 | B2 | 6/2005 | Barrie et al. | |
| 7,226,375 | B1 | 6/2007 | Sanford | |
| 7,234,220 | B1 * | 6/2007 | Grace, Jr. | F42B 6/08 29/428 |
| 7,377,869 | B2 | 5/2008 | Wohlfeil et al. | |
| 7,713,151 | B2 | 5/2010 | Fulton | |
| 7,713,152 | B1 | 5/2010 | Tentler et al. | |
| 7,905,802 | B2 | 3/2011 | Erhard | |
| 8,007,382 | B1 | 8/2011 | Sanford | |
| 8,043,177 | B2 | 10/2011 | Flanagan | |
| 8,105,187 | B1 | 1/2012 | Sanford | |
| 8,197,367 | B2 | 6/2012 | Pulkrabek et al. | |
| 8,313,399 | B2 | 11/2012 | Sanford | |
| RE44,144 | E | 4/2013 | Barrie et al. | |
| 8,449,416 | B2 | 5/2013 | Grace et al. | |
| 8,469,843 | B2 * | 6/2013 | Mizek | F42B 6/04 473/583 |
| 8,894,519 | B2 | 11/2014 | Young | |
| 9,097,500 | B1 | 8/2015 | Addleman | |
| 9,341,450 | B1 * | 5/2016 | Lin | F42B 6/08 |
| 2003/0153417 | A1 * | 8/2003 | Barrie | F42B 6/08 473/583 |
| 2006/0154757 | A1 * | 7/2006 | Sullivan | F42B 6/08 473/582 |
| 2008/0045363 | A1 * | 2/2008 | Pulkrabek | F42B 6/08 473/583 |
| 2008/0234079 | A1 * | 9/2008 | Butcher | F42B 6/08 473/584 |
| 2010/0173734 | A1 * | 7/2010 | Robbins | F42B 6/08 473/584 |
| 2012/0165142 | A1 | 6/2012 | Grace | |
| 2014/0031152 | A1 * | 1/2014 | Budris | F42B 6/08 473/583 |
| 2015/0105192 | A1 * | 4/2015 | Powell | F42B 6/08 473/583 |

* cited by examiner

FIG. 6A
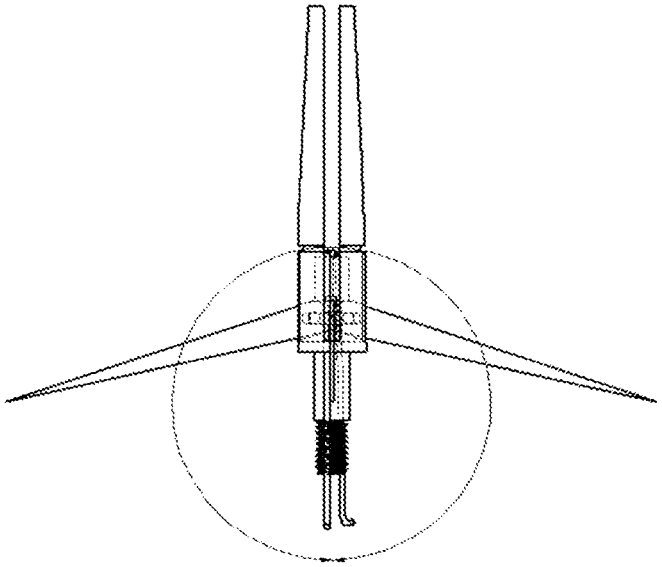
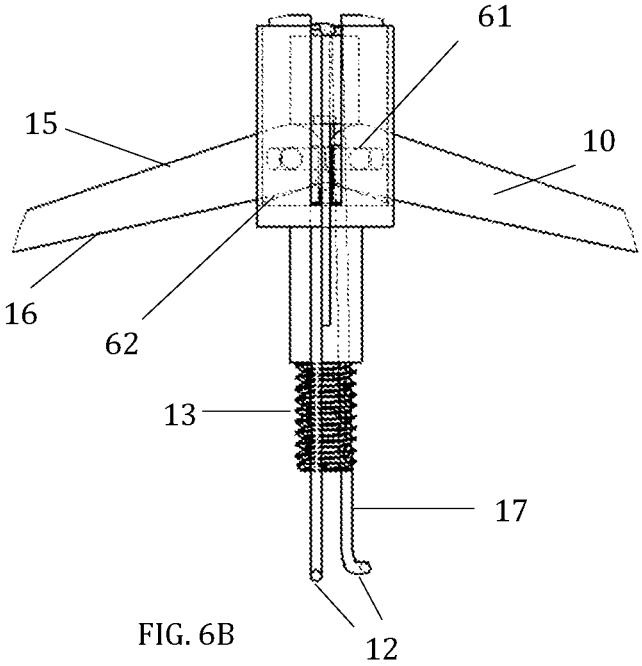
FIG. 6B

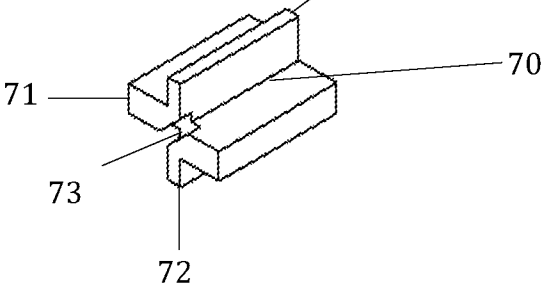
FIG. 7.A
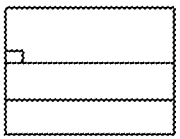
FIG. 7.C
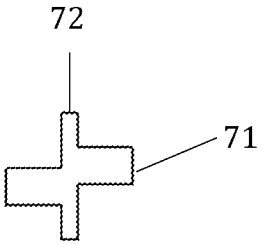
FIG. 7.D
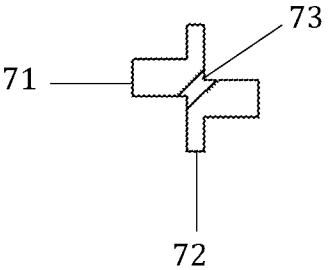
FIG. 7.B

FORWARD DEPLOYING, REAR ACTIVATED, DELAYED OPENING, BROADHEAD

CROSS REFERENCE TO RELATED APPLICATIONS

This application claims the benefit of provisional patent application Ser. No. U.S. 62/477,508 filed Mar. 28, 2017.

FIELD OF THE INVENTION

The present invention relates to modern detachable arrowheads. More particularly, the invention relates to a mechanical broadhead arrowhead that deploys from the forward position upon fully entering the target. Said mechanical broadhead has the ability to penetrate the outer surface of the target, including bone and soft tissue, before deploying its cutting blades. By penetrating before deploying of the additional cutting surfaces of the blades, the broadhead conserves kinetic energy and uses less kinetic energy than comparable broadheads in penetrating the outer surfaces of the target.

RELATED ART

Hunting with bow and arrow is a tradition older than the United States. The introduction of archery only hunting seasons has revived this practice and attracted new participants to the sport.

Historically, a hunter used a fixed broadhead made with exposed, fixed blades designed to cause lethal damage to the target. The blades allowed the arrow to produce additional damage beyond the radius of the shaft. However, such arrowheads proved cumbersome in flight and bulky to transport and store.

In modern times, mechanical broadheads have been introduced as a way to reduce the size of the arrow in storage and flight but retain the lethal advantage of a broadhead. In general terms, a mechanical broadhead contains blades that retract against or extend from the ferrule of the broadhead. Said blades remain in a closed position until deployed when impacting the target upon which impact the blades deploy to produce a wider cutting surface.

One problem with these traditional mechanical broadheads is that the retracted, undeployed blades remain exposed during flight. Exposed blades, even in a retracted position, create inflight drag experienced by the arrow-broadhead combination and cause degraded performance compared to a practice point arrow. (A practice point is simply a sharpened, cone shaped tip with no blades that attaches to an arrow.) To reduce inflight drag experienced when using broadheads for hunting the exposed blades must be minimized or eliminated. The extent to which this drag is reduced varies by the amount of blade remaining exposed and the presence of other mechanical pieces outside of the ferrule. The less blade exposed, the less drag experienced and the closer the broadhead performs to a practice point. Many existing broadheads reduce the exposure of the blades during flight, but no broadhead has been able to effectively eliminate this exposure and maintain acceptable performance.

Another problem with the current art of mechanical broadheads is blade deployment occurs prior to penetration. Blades deployed before penetration require the use of significant kinetic energy to penetrate the outer surfaces of the target, such as skin, soft tissue, and bone depending on the depth of penetration. The additional exposed surfaces of the broadhead, combined with the need to cut through a wider area of the target, increases the possibility of the arrow deflecting. Deploying blades upon impact, but prior to penetration, of the target does little to reduce the amount of energy expended when the blades cut through the outer surface of the target.

Another problem of existing mechanical broadheads is that they are complex in design and require a great number of moving parts. Each additional moving part adds cost, weight, inefficiency and a failure point to the broadhead. Attempts to reduce complexity of broadheads have resulted in reduced blade numbers, reduced overall blade surface, and suboptimal performance.

Another problem of existing mechanical broadheads is that the design leaves key parts exposed. Said exposure increases the damage and wear incurred when the broadhead strikes a target and thereby decreases the life span of the broadhead and increases the risk of failure.

Therefore a need exists for a reliable mechanical broadhead that is as streamlined in flight as a practice head, does not deploy blades until after the broadhead has already penetrated the outer surfaces of the target, internalizes moving parts to reduce wear and strain, and is relatively simple in design and function without sacrificing performance.

BRIEF SUMMARY OF THE INVENTION

The present invention, a forward deploying, rear activated, delayed opening broadhead, is a detachable arrowhead designed to attach to the forward end of an arrow shaft. In one embodiment of the present invention a broadhead is provided with a ferrule, tipped on the forward end with a fixed point designed to penetrate the target, and having on the opposite end an attachment end designed to be coupleable to an arrow shaft. Said ferrule includes a plurality of longitudinal slots and corresponding connection points for blades within and towards the rear of each of the longitudinal slots. In the shown embodiment, each slot is cut through and through and provides blade connection points for a blade on either side of the slot. In an embodiment with an odd number of slots, the slots would extend to the center axial leaving a hollow center. Each of a plurality of blades can be pivotally coupled to one of the connection points for blades within one of the plurality of the longitudinal slots. The blades can be pivotal between a forward position where each blade is fully recessed and protected in one of the longitudinal slots and an extended position with each blade extending radially outward from the ferrule. Contained within the ferrule in the longitudinal slots, adjacent to the blades, is a delayed opening trigger designed to catch upon the outer surface of the target after the majority of the ferrule has entered the target and to then force open the recessed blades within the target.

BRIEF DESCRIPTION OF THE DRAWINGS

These and other features and advantages of the present invention will become more readily appreciated as the same becomes better understood by reference to the following detailed description when considered in connection with the accompanying drawings, wherein:

FIG. 6.A is a fragmentary perspective view of the ferrule of one embodiment of the subject invention showing an area of interest towards the base of the subject invention.

FIG. 6.B is an enlarged view of the area of interest in FIG. 6.A, showing, in phantom, the blades, blade attachments, deployed deployment assist slide, and blade stops within the ferrule of one embodiment of the subject invention.

FIG. 7.A is a view of one embodiment of a deployment assist slide for the subject invention.

FIG. 7.B is a plan view from the forward most portion of one embodiment of a deployment assist slide for the subject invention.

FIG. 7.C is a view of one embodiment of a deployment assist slide for the subject invention.

FIG. 7.D is a view from the rearward most portion of one embodiment of a deployment assist slide for the subject invention.

DETAILED DESCRIPTION OF THE INVENTION

Figure 1:
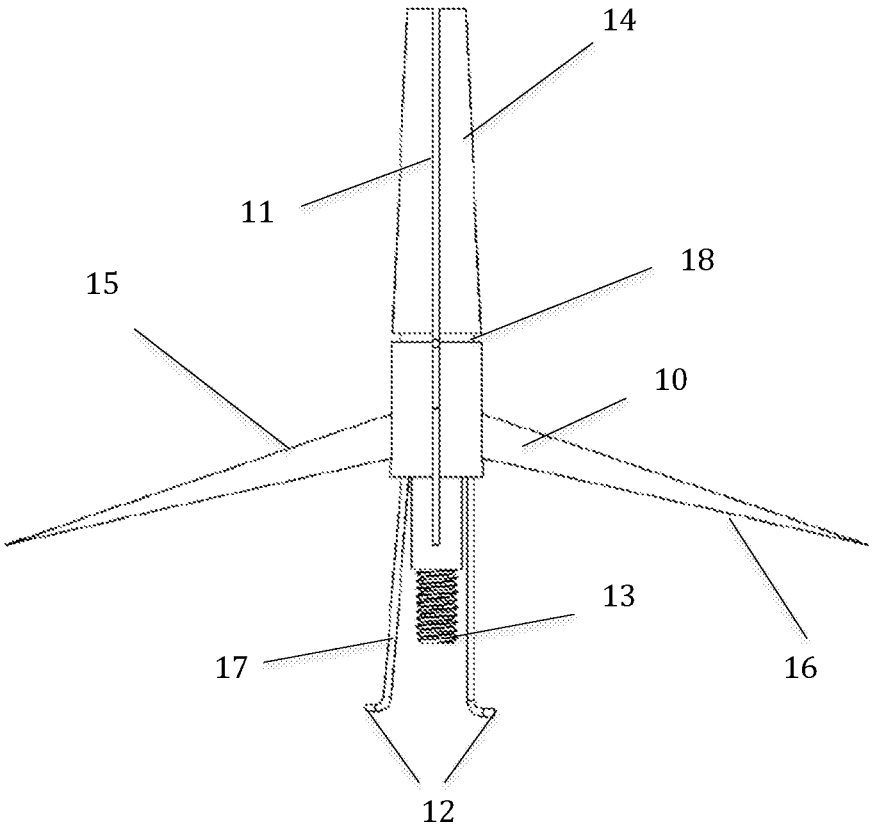
FIG. 1 is a perspective elevation view of the ferrule of one embodiment of the subject invention showing a fully deployed broadhead.
Figure 2:
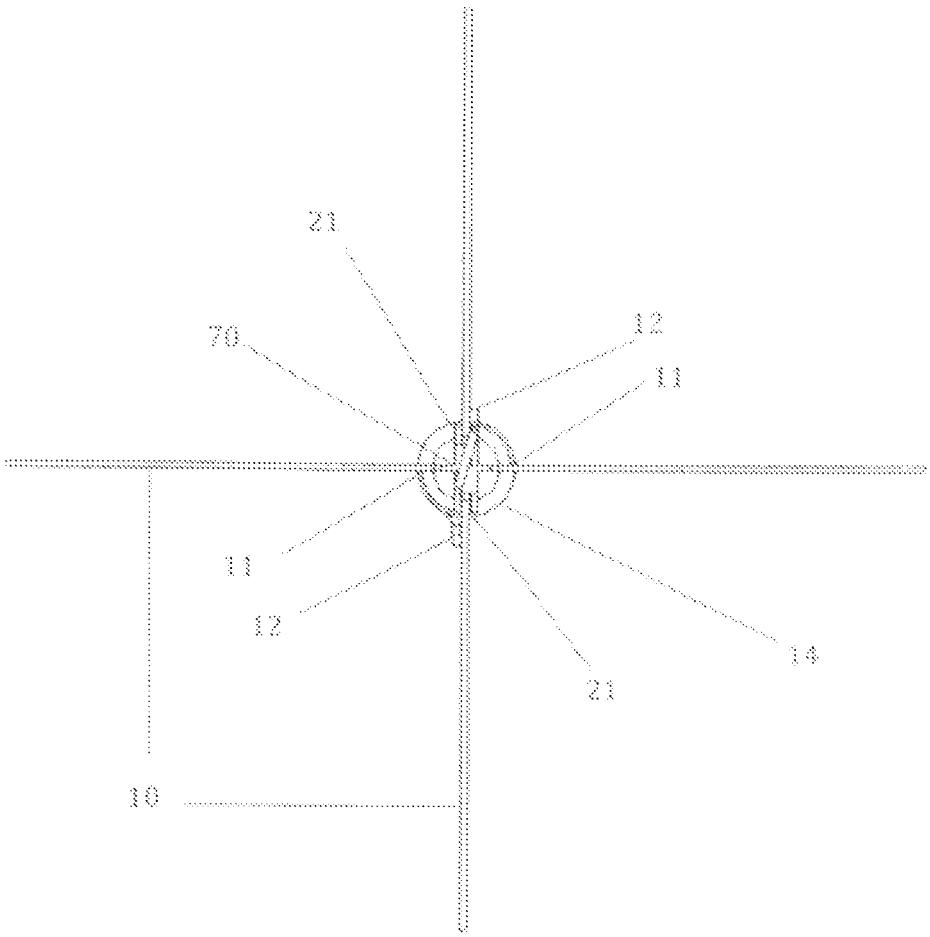
FIG. 2 is a fragmentary perspective plan view of one embodiment of the subject invention showing a fully deployed state with the tip of the broadhead removed to reveal the internal mechanics.
Figure 3:
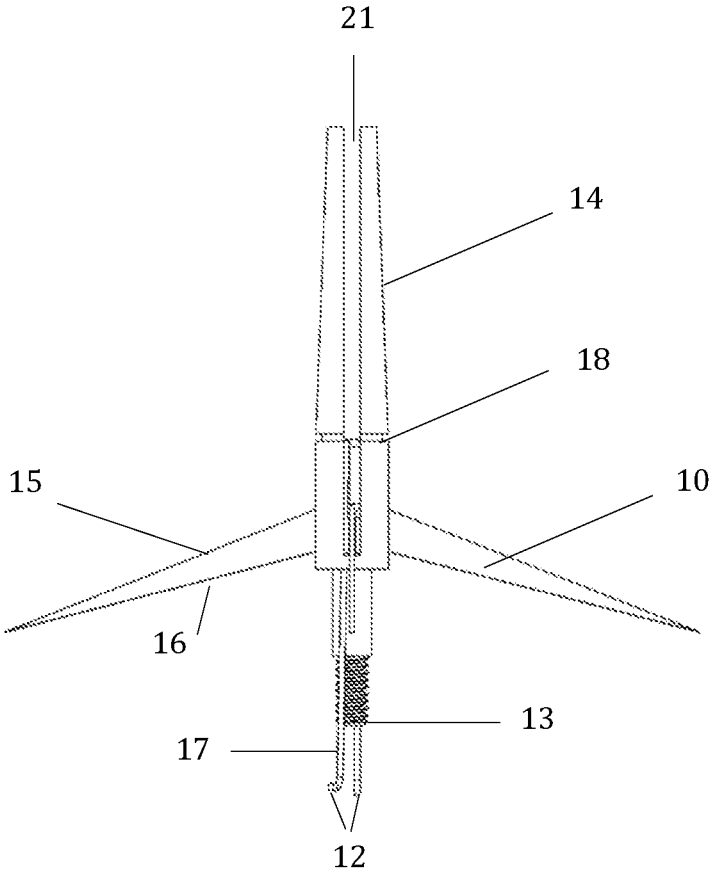
FIG. 3 is a perspective elevation view of the ferrule of one embodiment of the subject invention showing a fully deployed broadhead with the internal slot for a deployment mechanism.
Figure 4:
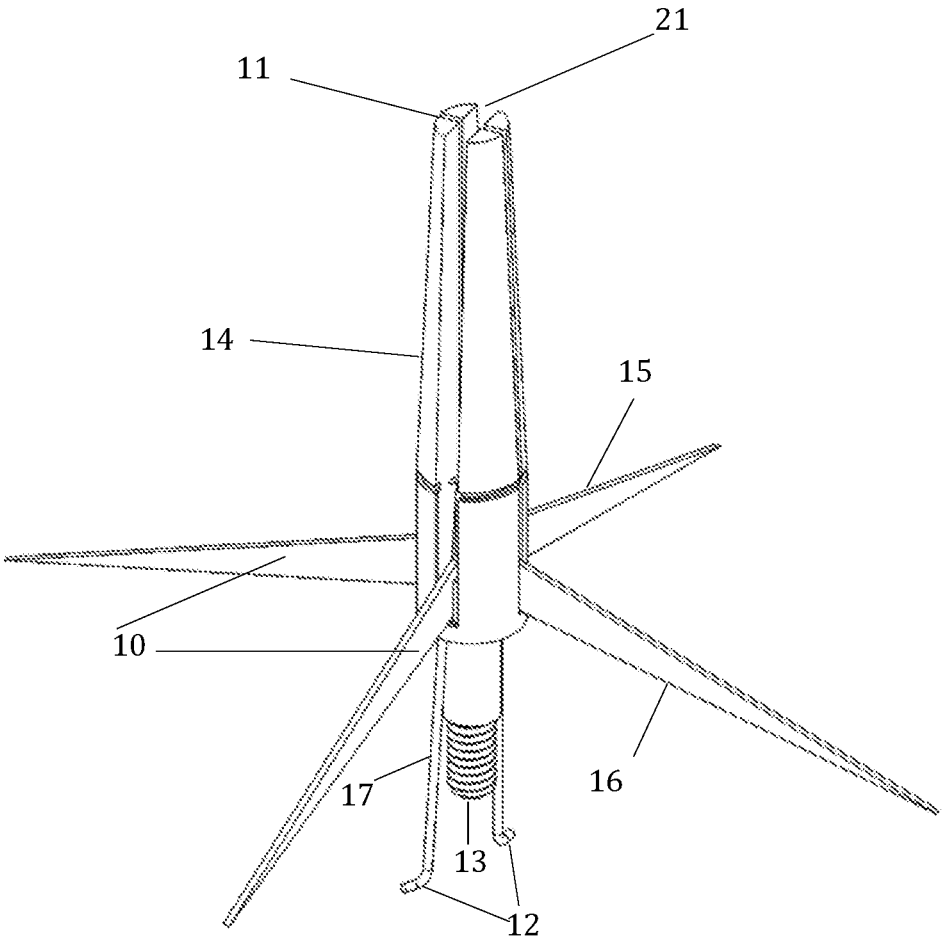
FIG. 4 is a perspective elevation view of the ferrule of one embodiment of the subject invention showing a fully deployed broadhead at an angle to reveal four blade slots in the ferrule.
Figure 5:
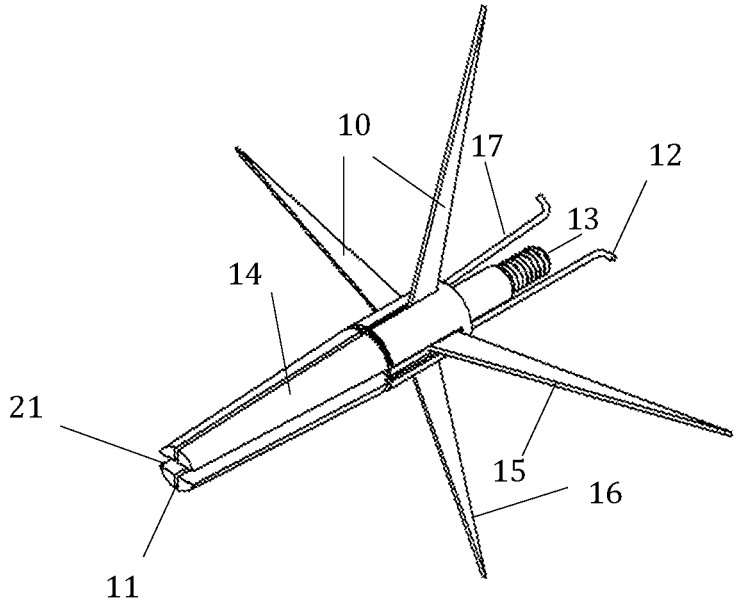
FIG. 5 is a perspective view of the ferrule of one embodiment of the subject invention showing a fully deployed broadhead.
Figure 8:
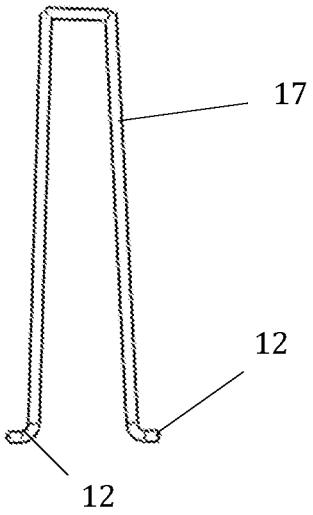
FIG. 8 is an elevation view of one embodiment of a trigger device mechanism for the subject invention.
Figure 9:
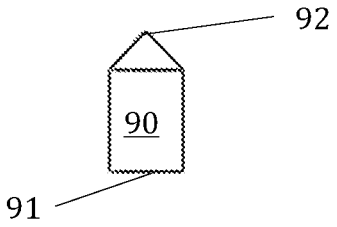
FIG. 9 is an elevation view of the arrow tip of one embodiment of the subject invention.
Figure 10:
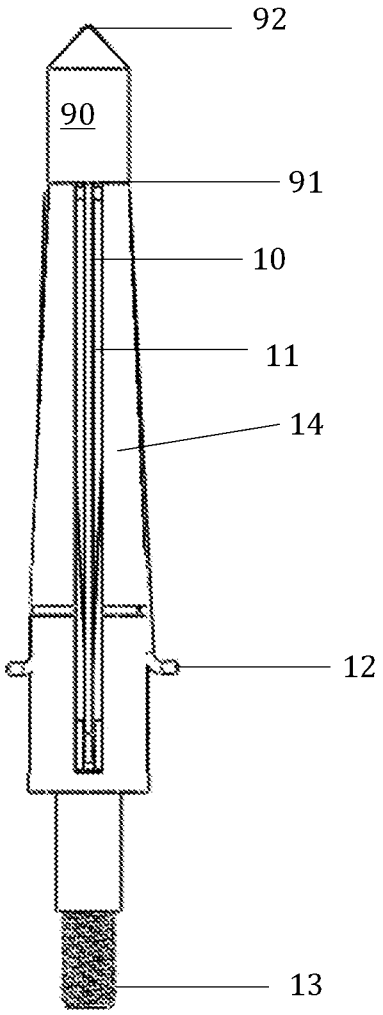
FIG. 10 is a view of one embodiment of the subject invention fully assembled and in an un-deployed state.
Figure 11:
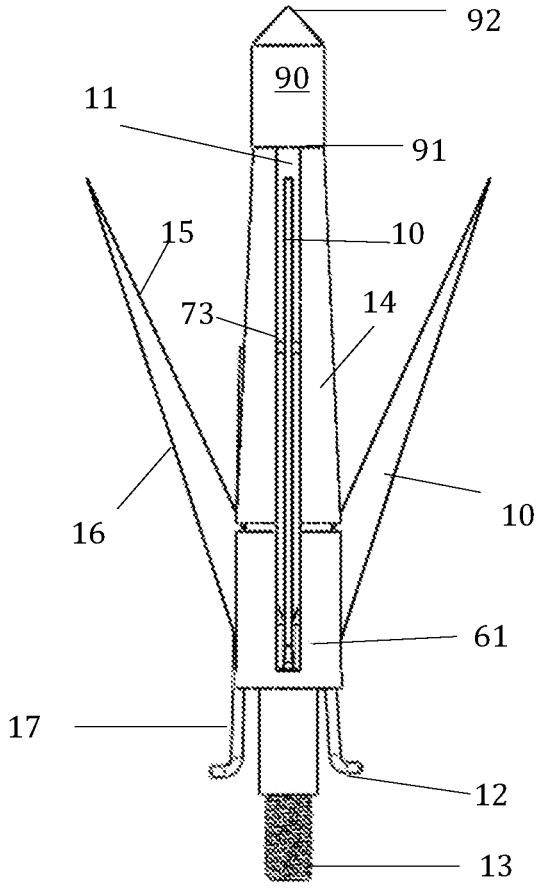
FIG. 11 is a view of one embodiment of the subject invention fully assembled and in a partially deployed state.
Figure 12:
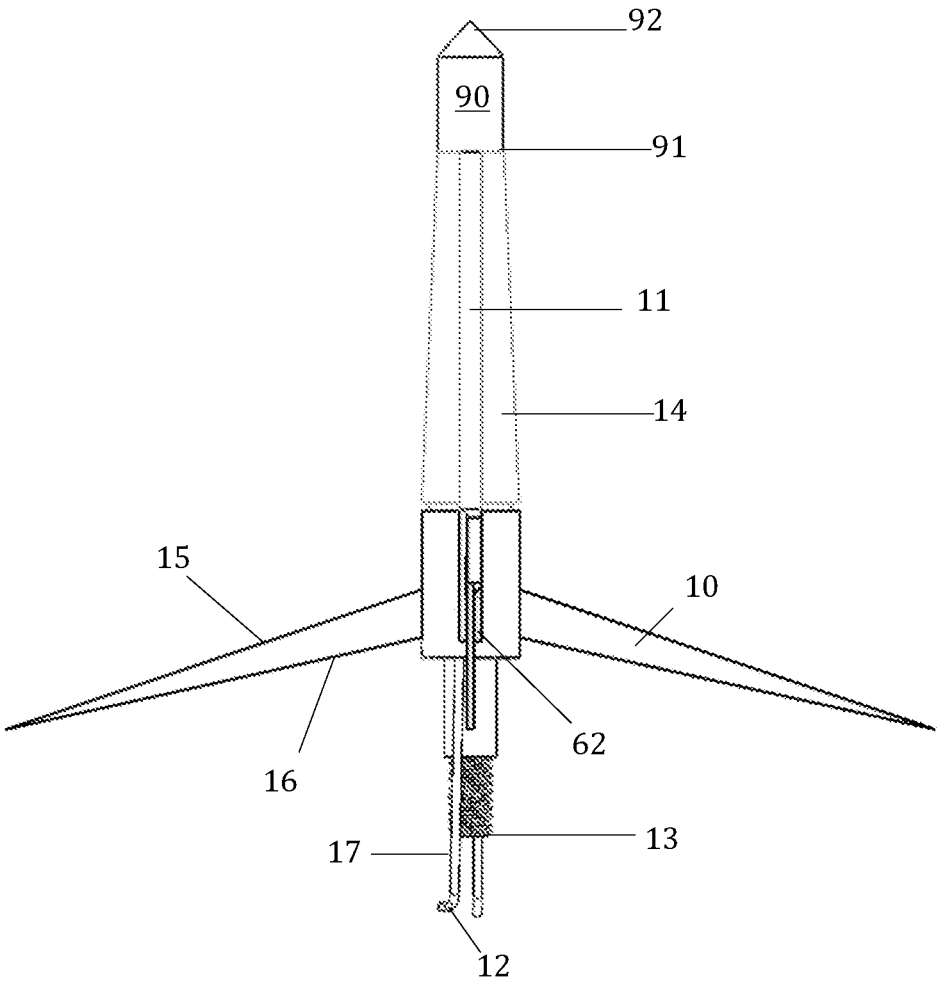
FIG. 12 is a view of one embodiment of the subject invention fully assembled and in a fully deployed state.

Mickey Lankford has invented a Forward Deploying, Rear Activated, Delayed Opening, Broadhead. Reference is now made to the exemplary embodiments illustrated in the drawings and specific language is used herein to describe the same. Nevertheless it should be understood that no limitation of the scope of the invention is hereby intended.

As used herein, "distal" refers to the end of the broadhead ferrule where the pointed tip is attached, and "proximal" refers to the end of the broadhead ferrule that couples to the arrow shaft. The numerals referenced from the drawings identify similar or identical elements throughout the several views. The attached figures illustrate a forward deploying, rear activated, delayed opening, broadhead, which comprises a tip, a ferrule, a deployment assist slide, a triggering device, blades, and an o-ring.

The embodiments of the present invention generally provide for a mechanical broadhead arrow tip device that can attach to an arrow shaft. Generally, the mechanical broadhead is designed to remain closed during flight and to deploy as the proximal end of the ferrule (14) penetrates the target thereby allowing the body of the broadhead and the blades (10) to fully enter the target prior to deployment. At deployment, the blades (10) open radially from the blade connection points (61) within the blade slots (11 and 21) of the ferrule (14).

In one embodiment of the invention, the broadhead consists of a ferrule (14) with a plurality of longitudinal blade slots (11 and 21) spaced radially apart, a plurality of blades (10) which can each be pivotally coupled to the ferrule at the blade connection point (61) within one of the longitudinal blade slots (11 and 21), a tip (90), a trigger device (17) approximately the shape of an inverse 'U' with l' shaped legs, the tips of which legs serve as an actuating catch (12) and a deployment assist slide (70). The ferrule (14) can be crowned at the distal most point with a tip (90) that couples with the ferrule at said tip's (90) proximal end (91). The proximal end of the ferrule (14), features a means to couple (13) the ferrule to an arrow shaft. In one embodiment this means is a threaded protrusion (13) sized to screw into a standard arrow.

The ferrule (14) contains longitudinal blade slots (11 and 21) and the number of blade slots (11 and 21), and corresponding blades (10), vary between different embodiments of the invention. In the shown embodiment, there are two smaller blade slots (11), two larger blade slots (21), and four blades (10). The smaller blade slots (11) are cut through and through and the larger blade slots are likewise cut through and through. Together, the cuts of the longitudinal blade slots create a hollowed opening along the central axis of the ferrule from the distal end towards the proximal end.

The longitudinal blade slots (11 and 21) can be of different widths and lengths. The smaller longitudinal blade slots (11) are wide enough to accept the corresponding blade (10) and long enough to allow the entire blade to be enclosed within the ferrule when in the retracted position. The larger longitudinal blade slots (21) are wide enough to accept the corresponding blade (10) and the trigger device (17) when placed parallel or nearly parallel to one another. Further, the larger longitudinal blade slots (21) may be of differing length and/or varied width depending on the desired placement of the actuating catch (12) of the trigger device (17).

To increase the depth of penetration before deployment, the actuating catch (12), shown in the present embodiment as the tips of the 'L' shaped legs of the trigger device (17) are set rearward near the proximal end of the ferrule (14). The larger longitudinal blade slots (21) may extend past the blade connection points (61) for the blades (10) and thereby allow the actuating catch (12) to extend outward from the ferrule (14) closer to the proximal end than the blade connection points (61) and the base of the blades (10). The width of the longer longitudinal blade slots (21) in this extension narrows rearward the blade connection points (61) to a width wide enough to accept the trigger device (17). Without need to accept the retracted blades rearward the blade connection points (61), the larger longitudinal blade slots (21) are narrowed only to accept the trigger device (17).

In such a configuration, the broadhead penetrates the target to a depth as deep as the entire length of the blade (10) and the tip (90) combined are long, before the primary initiation of blade deployment occurs. This delayed deployment differentiates this broadhead from prior art that initiates deployment of the blades prior to the entire length of the blade entering the target. Once blade deployment is initiated by contact of the actuating catch (12) with the surface of the target, the exposed blades will snag within the target and thereby act as the secondary deployment mechanism.

To decrease the depth of penetration before deployment, the the actuating catch (12) is set nearer the distal end of the ferrule (14). The larger longitudinal blade slots (21) may be only partially used for accepting the trigger device (17), or the widened width of the larger longitudinal blade slots (21) may be shortened to only accept the shortened trigger device (17). In such a configuration, the narrower width of the larger longitudinal blade slots (21) would still extend the length of the blades (10) to the blade connection points (61). In said configuration, the broadhead deploys sooner and with less penetration prior to deployment, which may be desirable on thin-skinned game or where reduced penetration is preferable.

The blades (10) can be triangular in shape and each blade can be pivotally coupled to the ferrule (14) at the blade connection point (61) within one of the longitudinal blade slots (11 and 21). Each blade (10) can pivot inward radially at the blade connection point (61) and prior to deployment rest in a retracted position fully recessed into one of the blade slots (11 and 21) in the ferrule (14). Each longitudinal blade slot (11 and 21) within the ferrule can contain a blade connection point (61) located within the blade slot (11 and 21) and towards the proximal end of the blade slot (11 and 21). The base of each triangularly shaped blade (10) provides a means to couple the blade to the blade connection point (61) within one of the longitudinal blade slots (11 and 21) of the ferrule (14). In one embodiment of the current invention, the blade connection point (61) may be a pin upon the ferrule and a matching hole within the blade.

The fixed tip (90) of the broadhead crowns the ferrule (14) by coupling the base of the tip (91) to the ferrule (14). The tip (90) may be attached to the ferrule (14) by any number of means. In one embodiment, epoxy or other glue like substance is used at the rear of the tip (91) to attach the tip (90) to the ferrule (14). In another embodiment, the rear of the tip (91) is hollow and designed to slide over the ferrule (14) and hold the fixed tip (90) in place by friction. The fixed tip (90) can be made from a hardened metal or other similar material and designed to penetrate bone, cartilage, gristle, sinew or any combination thereof. The sharpened point (92) of the fixed tip (90) allows the ferrule (14) to penetrate the target prior to deployment of the blades (10). The diameter of the fixed tip (90) is larger than the diameter of the distal end of the ferrule (14) and can be larger than the diameter of the majority of the ferrule (14). The greater diameter of the fixed tip (90) reduces the amount of friction experienced by the ferrule (14) upon penetrating the target and thus allows for deeper penetration. Additionally, the greater diameter of the fixed tip (90) creates an air pocket behind the fixed tip (90) within the target, which allows for starting blade deployment with less resistance.

In a common embodiment, the forward edge (15) of each blade is sharpened and faces inward towards the ferrule and the rearward edge of each blade (16) faces outward when the blades (10) are folded into the recessed blade slots (11 and 21) prior to deployment. In another embodiment, both the forward edge (15) and the rear edge of each blade (16) are sharpened.

In one embodiment of the invention, the ferrule (14) is circularly grooved (18) forward the blade connection point (61) between the blades (10) and the ferrule (14). In one embodiment of the invention, the blades (10) are held within the blade slots (11 and 21) of the ferrule (14) by a retaining device placed around the ferrule at the circular groove (18). Said retaining device may be an o-ring, tape, shroud, or any other means of securing the blades (10) within the blade slots (11 and 21) of the ferrule (14). The retaining device can resist movement of the blades so as to maintain the blades in the retracted position until the deployment assist slide (70) forces deployment. Upon deployment the blades (10) open radially from the front of the broadhead, the retaining device is pushed off, and the sharpened edges (15) face forward towards the target and the back of the blades (16) face rearward away from the target. In another embodiment of the invention, both the forward (15) and rear edges (16) of the blades (10) are sharpened.

In one embodiment the present invention can contain triggering hardware comprised of an inverse 'U' shaped trigger device (17) with two 'L' shaped legs, the tips of which serve as the actuating catch (12) and a deployment assist slide (70). The trigger device (17) resembles a 'SZ' with sharp corners rather than curves. When the blades (10) are in the retracted position, the deployment assist slide (70) is located within the longitudinal slots (11 and 21) of the ferrule (14) with the majority of the deployment assist slide (70) forward the tips of the retracted blades (10). The tips of the blades (10) may rest upon the proximal end of the deployment assist slide (70) which thereby serves as a stop to prevent the blades (10) from over recessing or binding in the ferrule (14) in the retracted position. In the retracted position, the top of the 'Ω' shaped trigger device (17) rests within a slot (73) cut across the top of the deployment assist slide (70), each length of the trigger device leading up to the actuating catch (12) rests within the enlarged blade slots (21), and the actuating catch (12) protrudes roughly perpendicular away from the ferrule (14) nearer the proximal end than any retaining device (18).

In another embodiment of the present invention, the trigger device (17) may be comprised of separate pieces that connect to the deployment assist slide (70). Generally, the assembled trigger device (17) and deployment assist slide (70) will function as the embodiment described above.

The deployment assist slide (70) and trigger device (17) are majority internal within the longitudinal slots (11 and 21) of the ferrule (14). Only the actuating catch (12) of the trigger device (17) is external of the ferrule (14). The internal position of the deployment assist slide (70) and trigger device (17) protect these parts from exposure and damage in flight or upon impact. Likewise, the blade connection points (61) where the blades (10) mount to the ferrule (14) are contained within the ferrule in the longitudinal slots (11 and 21) and thus protected from exposure and damage in flight or upon impact. The protected position of these components increases the durability of the invention.

In one embodiment of the invention with four blades (10), the deployment assist slide (70) resembles a lop-sided plus sign. In such embodiment, the cross bars of the slide (71 and 72) are designed to fit into the blade slots (11 and 21) of the ferrule (14). The smaller cross bar (72) loosely fills the smaller blade slot (11) within the ferrule (14). The larger cross bar (71) loosely fills the larger blade slot (21) of the ferrule (14) leaving enough room for the larger blade slot (21) to also contain the triggering device (17). The forward most part of the deployment assist slide (70) can contain a diagonal notch (73) cut to accept the triggering device (17) resting across it. In other embodiments of the invention, the deployment assist slide (70) can be shaped to fit into the longitudinal blade slots (11 and 21), such slots variable in number to fit the purpose of the broadhead.

Deployment is triggered when the ferrule enters the target up to the exposed actuating catch (12) and said actuating catch makes contact with the outer surface of the target. The actuating catch (12) is designed to snag upon the outer surface of the target and to penetrate the target at a slower rate than the rest of the broadhead. Thereby, the actuating catch (12), and the trigger device (17) to which it is attached, moves rearwards, as compared to the relative position of the broadhead, as the broadhead penetrates through the target. As the trigger device (17) moves rearward it exerts rearward force upon the deployment assist slide and moves the slide towards the proximal end. As the deployment assist slide (70) moves towards the proximal end of the ferrule (14) it exerts pressure upon the blades (10) causing the blades (10) to radially open from the front of the ferrule (14). The depth of penetration before deployment is initiated can be varied by changing where upon the ferrule (14) the actuating catch (12) protrudes outward from the ferrule. In a preferred embodiment, deployment is not triggered until the majority of the ferrule (14) and of the retracted blades (10), have entered the target. In another embodiment, the actuating catch (12) is set closer to the proximal end of the ferrule (14) than the blade connection points (61) and deployment is not triggered until the entire length of the blades (10) have penetrated the target within the ferrule (14) in the retracted position.

The actuating catch (12), via the triggering device (17) is connected to a deployment assist slide (70) located internal the ferrule (14) within the longitudinal slots (11 and 21) with the majority of the deployment assist slide (70) forward the tip of the retracted blades (10), and upon exerting rearward force from the friction of entering the target, the actuating catch (12) moves rearward, i.e. towards the proximal end, of the broadhead pulling the triggering device (17) and deployment assist slide (70) rearward with the actuating catch (12). The deployment assist slide (70), in moving rearward along the recessed, triangular shaped blades (10), forces the blades (10) to extend radially away from the ferrule (14) and thereby pushes the blades out of the recessed position within the blade slots (11 and 21) in the ferrule (14). The opening in the target made by the fixed tip (90) eases any resistance caused by the target in the initial deployment. Once the tips of the blades (10) are exposed, the blades themselves will snag into the target and be pushed open without further assistance from the deployment assist slide (70), triggering device (17), or actuating catch (12). Together, the rearward pressure exerted by the actuating catch (12), via the triggering device (17) and the deployment assist slide (70), and the natural snagging motion exerted once the blades (10) are partially opened, forces the blades (10) of the broadhead to fully open radially and thereby deploy the broadhead. As the broadhead further enters the target, the actuating catch (12) will stop moving rearward and the triggering device (17) will bend towards the ferrule (14) and arrow as the actuating catch, and the triggering device (17) enter the target.

In the pictured embodiment, the positioning of the actuating catch (12) aft the retaining device position (18) on the ferrule (14) allows the majority of the broadhead to penetrate the outer surface of the target prior to deployment of the blades (10). Therefore the blades (10) are deployed inside the target and kinetic energy is not expended cutting through the outer surface of the target. Such mechanism leaves more kinetic energy to expend penetrating into and cutting vital organs and meat rather than cutting through skin and the outer surfaces of the target.

The deploying blades (10), opening from the front and extending radially from the ferrule (14) at the blade connection point (61) towards the proximal end of the blade slots (11 and 21), will pivot rearward and radially out until further deployment is stopped by the solid base (62) of the ferrule (14). The shape of the ferrule (14) and the solid base (62) is so designed that the blades (10) open at least 90 degrees from the central axis of the ferrule (14), but not more than 170 degrees from the central axis of the ferrule (14). Such angle ensures that the blades (10) remain open during penetration of the target but do not open so much as to collapse upon the ferrule (14) and thereby reduce the effective cutting diameter of the broadhead. The shape of the ferrule (14) and solid base (62) can be further designed to provide support to the extended blades to strengthen the extended position. One embodiment of such a design is a cut at the end of the longitudinal slots (11 and 21) in the ferrule (14) to tightly house the base of the blades (10) and prevent unwanted movement of the same. The shape of the deployment assist slide (70) may be designed to compliment the base of the longitudinal blade slots (11 and 21) and thereby provide further structure to reinforce and strengthen the hold of the blades (10).

Upon exit from the target, the broadhead will remain deployed until reset by the user. The user may reset the broadhead by sliding the deployment assist slide (70) attached to the trigger device (17) and actuating catch (12) forward within the ferrule (14) and folding the blades (10) forward, towards the tip (90) of the broadhead. The blades should re-enter the blade slots (11 and 21) in the ferrule (14) and again be recessed and ready for the next use. A retaining device may be placed around the ferrule (14) at the circular groove (18) to hold the blades (10) within the blade slots (11 and 21).

What is claimed is:

1. An arrowhead tip for attachment to an arrow shaft, said tip comprising:

a) a ferrule, said ferrule elongated and concentric in shape and having a central, elongate axis, a distal end, a proximal end, a plurality of longitudinal slots cut from the concentric surface of the ferrule to the elongate axis, connecting with one another at the elongate axis, and extending longitudinally along the elongate axis from the distal end towards the proximal end of said ferrule, and a blade connection point within each longitudinal slot near the proximal end of said slot;

b) a plurality of blades corresponding in number with the longitudinal slots of the ferrule and coupled to each of the blade connection points in the longitudinal slots, each blade including a mounting end and a tip;

c) a triggering device having a connecting end, an opposite end, a leg extending roughly perpendicular from the connecting end to the opposite end and slightly shorter in length than the longitudinal slots of the ferrule, and an actuating catch at the opposite end, said actuating catch protruding roughly perpendicular from said leg;

d) a deployment assist slide generally shaped to loosely fit internal within the longitudinal slots in the ferrule and having connecting points to accept the triggering device, and a proximal end shaped such that when moved from the distal end of the ferrule along the elongate axis towards the proximal end of the ferrule said proximal end of the slide engages the tips of the blades and forces the blades in the longitudinal slots of the ferrule to open radially away from the ferrule starting at the distal end; and e) a tip integrally attached at the distal end of said ferrule and tapered symmetrically about the elongate axis to form a point oriented in a proposed direction of flight;

f) wherein the proximal end of the ferrule is configured along the elongate axis to enable the arrowhead tip to attach securely to an end of an arrow shaft;

g) wherein each of said blades is pivotally coupled at the mounting end to the blade connection point within the corresponding longitudinal slot of the ferrule such that the blades may pivot between a retracted position with each blade fully recessed into the corresponding longitudinal slot along the elongate axis and an extended position with the tip of each blade extending radially outward from the blade connection point within the corresponding longitudinal slot;

h) wherein the deployment assist slide rests within the longitudinal slots of the ferrule at the distal end of the ferrule when the blades are in the retracted position and when said deployment assist slide is moved within the longitudinal slots from the distal end of the ferrule towards the proximal end the deployment assist slide engages the tips of the blades and forces the blades in the longitudinal slots of the ferrule to open radially away from the ferrule starting at the distal end; and i) wherein the triggering device is connected at the connecting end to one of the connecting points of the deployment assist slide and the leg of the triggering device lays within one of the longitudinal slots with only the actuating catch protruding outward from the concentric surface of the ferrule at the proximal end of the longitudinal slots.

2. The apparatus as in claim 1 wherein the blades have a forward edge that faces into the ferrule when said blade is in the retracted position and faces a target when said blade is in the extended position, a rear edge that faces away from the ferrule when said blade is in the retracted position and faces away from the target when said blade is in the extended position.

3. The apparatus as in claim 2 wherein the forward edge of each blade, the rear edge of each blade, or both are sharpened.

4. The apparatus as in claim 1 where the longitudinal slots in the ferrule are shaped at the proximal end to stop the radially extending blades between 90 degrees and 170 degrees as measured from the elongate axis of the ferrule to a forward edge of each blade.

5. The apparatus as in claim 1 where the ferrule is ringed around the ferrule's concentric surface forward the blade connection points with a slot designed to secure a retaining device that in turn secures the blades in the retracted position.

6. A broadhead arrow tip device comprising a ferrule elongated and concentric in shape and having a central, elongate axis, a distal end, a proximal end, a plurality of longitudinal slots cut through to the elongate axis of the ferrule and extending from the distal end of the ferrule towards the proximal end of the ferrule with each longitudinal slot containing a blade connection point within the proximal end of the longitudinal slot, a plurality of blades, equal in number to the number of longitudinal slots, with a blade connected within each of the longitudinal slots at the blade connection point and able to pivot between a retracted position fully recessed within said longitudinal slot and an extended position extending radially outward from the ferrule, and a deployment assist slide that fits internal within the longitudinal slots of the ferrule, without protruding outwardly from said longitudinal slots, and shaped such that when moved from the distal end of the ferrule towards the proximal end said deployment assist slide forces the blades in the longitudinal slots to open radially away from the ferrule starting at the distal end.

7. The apparatus as in claim 6 where the proximal end of the ferrule is configured to attach to an arrow shaft on an end of said shaft.

8. The apparatus as in claim 6 where the deployment assist slide has connection points and said apparatus further comprises a) a trigger device having a connecting end, an opposite end, a leg that connects the connecting end to the opposite end, and an actuating catch on the opposite end that extends roughly perpendicular from the axis of the leg; and b) wherein the connecting end of the trigger device is connected to one of the connection points of the deployment assist slide, the leg of the trigger device is within one of the longitudinal slots of the ferrule, and the actuating catch protrudes outward from the concentric surface of the ferrule at the proximal end of the longitudinal slot.

9. The apparatus as in claim 2 further comprising a tip integrally attached at the distal end of said ferrule and tapered symmetrically about the elongate axis to form a point oriented in a proposed direction of flight.

10. The apparatus as in claim 6 wherein the blades have a forward edge that faces into the ferrule when said blade is in the retracted position and faces a target when said blade is in the extended position, a rear edge that faces away from the ferrule when said blade is in the retracted position and faces away from the target when said blade is in the extended position, a pointed tip that lies within one of the longitudinal slots in the ferrule and near the distal end of the ferrule when the blade is in the retracted position and is an outermost point of the blade when said blade is in the extended position, and a mounting end designed to connect to the blade connection point within one of the longitudinal slots of the ferrule in a manner that allows the blade to pivot radially from the retracted position to the extended position.

11. The apparatus as in claim 10 wherein the forward edge of each blade, the rear edge of each blade, or both are sharpened.

12. The apparatus as in claim 6 where the longitudinal slots in the ferrule are shaped at the proximal end to stop the radially extending blades between 90 degrees and 170 degrees as measured from the elongate axis of the ferrule to a forward edge of each blade.

13. The apparatus as in claim 6 where the ferrule is ringed around the ferrule's concentric surface forward the blade connection points with a slot designed to secure a retaining device that in turn secures the blades in the retracted position.

14. A method for making a broadhead arrow tip device comprising a ferrule elongated and concentric in shape and having a central, elongate axis, a distal end, a proximal end, a plurality of longitudinal slots cut through to the elongate axis of the ferrule and extending from the distal end of the ferrule towards the proximal end of the ferrule with each longitudinal slot containing a blade connection point within the proximal end of the longitudinal slot, a plurality of blades, equal in number to the number of longitudinal slots, with a blade connected within each of the longitudinal slots at the blade connection point and able to pivot between a retracted position fully recessed within said longitudinal slot and an extended position extending radially outward from the ferrule, and a deployment assist slide that fits internal within the longitudinal slots of the ferrule, without protruding outwardly from said longitudinal slots, and shaped such that when moved from the distal end of the ferrule towards the proximal end said deployment assist slide forces the blades in the longitudinal slots to open radially away from the ferrule starting at the distal end, comprising: a) positioning a deployment assist slide internally within a ferrule of a broadhead arrow tip such that the slide may move freely from the distal end of the ferrule towards the proximal end the ferrule along the elongated axis of the ferrule; b) connecting the deployment assist slide to a trigger; and c) positioning the trigger such that resistance from entering a target provides sufficient force to push the trigger towards the proximal end of the ferrule and pull the deployment assist slide within the ferrule towards the proximal end of the ferrule.

15. The method of claim 14 further comprising shaping the deployment assist slide so a proximal end of the deployment assist slide engages a forward tip on each of the plurality of blades pivotally coupled to the ferrule each within one of the longitudinal blade slots such that when the deployment assist slide is pushed towards the proximal end of the ferrule said deployment assist slide engages the forward tip on each of the plurality of blades and pivots said blades from a retracted position within the longitudinal slots to an extended position in which each blade extends radially outward from the ferrule.

16. The method of claim 14 further comprising positioning the trigger towards the proximal end of the ferrule and delaying engagement of the trigger until after a majority of the ferrule has entered the target.

* * * * *